US011631561B2

(12) United States Patent
Bossoni et al.

(10) Patent No.: US 11,631,561 B2
(45) Date of Patent: Apr. 18, 2023

(54) ELECTRICALLY CONTROLLED SWITCH FOR HIGH CURRENT SWITCHING OPERATIONS WITH DIFFERENT CONFIGURATIONS OF FIXED TERMINAL CONTACTS

(71) Applicant: MICROELETTRICA SCIENTIFICA S.P.A, Buccinasco (IT)

(72) Inventors: Carlo Bossoni, Milan (IT); Davide Faioni, Milan (IT)

(73) Assignee: MICROELETTRICA SCIENTIFICA S.P.A.

( * ) Notice: Subject to any disclaimer, the term of this patent is extended or adjusted under 35 U.S.C. 154(b) by 22 days.

(21) Appl. No.: 17/277,091

(22) PCT Filed: Aug. 27, 2019

(86) PCT No.: PCT/EP2019/072772
§ 371 (c)(1),
(2) Date: Mar. 17, 2021

(87) PCT Pub. No.: WO2020/057902
PCT Pub. Date: Mar. 26, 2020

(65) Prior Publication Data

US 2022/0059306 A1 Feb. 24, 2022

(30) Foreign Application Priority Data

Sep. 17, 2018 (EP) ..... 18194811

(51) Int. Cl.
*H01H 50/16* (2006.01)
*H01H 50/54* (2006.01)

(52) U.S. Cl.
CPC ..... *H01H 50/16* (2013.01); *H01H 50/54* (2013.01)

(58) Field of Classification Search
CPC ..... H01H 50/16; H01H 50/54; H01H 71/08; H01H 11/0031; H01H 3/28; H01H 9/446
See application file for complete search history.

(56) References Cited

U.S. PATENT DOCUMENTS 2,041,250 A 5/1936 Kalwitz
4,635,014 A * 1/1987 Erb ..... H01H 1/54 218/32

(Continued)

FOREIGN PATENT DOCUMENTS

EP 645792 A1 3/1995
EP 2107587 B1 11/2014

(Continued)

OTHER PUBLICATIONS

Machine translation of Hager [EP0645792] (Year: 1995).*
International Search Report corresponding to PCT/EP2019/072772, dated Jan. 2, 2020.

*Primary Examiner* — Bernard Rojas
(74) *Attorney, Agent, or Firm* — Barnes & Thornburg LLP

(57) ABSTRACT

Disclosed embodiments relate to an electrically controlled switch for high current switching operations and with different configurations of fixed terminal contacts that includes a switch body, a couple of moving contacts, a guide that drives the couple of moving contacts up to an abutting position, a housing groove running perimetric in the switch body, and at least one contact bar for connecting each of the moving contact to a respective fixed terminal contact of the switch, wherein the contact bar is hosted within the housing groove and has a free end projecting from the switch body to form the fixed terminal contact through a corresponding aperture of the switch body located on a same lateral side or on opposite lateral sides, or on the base support, respectively.

14 Claims, 6 Drawing Sheets

(56) References Cited

U.S. PATENT DOCUMENTS

| | | | | |
|---|---|---|---|---|
| 7,084,727 | B2 | 8/2006 | Bauer et al. | |
| 2013/0284703 | A1* | 10/2013 | Yoshitomo ..... | H01H 33/98<br>218/84 |

FOREIGN PATENT DOCUMENTS

| | | | |
|---|---|---|---|
| EP | 3293748 | A1 | 3/2018 |
| RU | 78984 | U1 | 12/2008 |
| RU | 2558391 | C2 | 8/2015 |
| WO | 2014096580 | A1 | 6/2014 |

* cited by examiner

ELECTRICALLY CONTROLLED SWITCH FOR HIGH CURRENT SWITCHING OPERATIONS WITH DIFFERENT CONFIGURATIONS OF FIXED TERMINAL CONTACTS

CROSS REFERENCE AND PRIORITY CLAIM

This patent application is a U.S. National Phase of International Patent Application No. PCT/EP2019/072772 filed Aug. 27, 2019, which claims priority to European Patent Application No. 18194811.8, the disclosure of which being incorporated herein by reference in their entireties.

FIELD

The disclosed embodiments relate to an electrically controlled switch for high current switching operations and with different configurations of fixed terminal contacts. More specifically, but not exclusively, the disclosed embodiments relate to contactors and disconnectors suitable for being used in different locations.

BACKGROUND

As it is well known in this specific technical filed, contactors and disconnectors are remote control electric devices used respectively as switches driven by an electromagnetic actuator or for de-energizing an electrical circuit.

Generally speaking, contactors are available in a wide range for instance from those having a breaking current of several amperes to thousands of amperes and from 24 V DC to many kilovolts, but they are not intended to interrupt a short circuit current. In many case, as soon as a sufficient starting current flows through the contactor electromagnet, the contactor responds and turns on the loads connected in the load circuit. To maintain the contactor in this state, a holding current must flow through the contactor. After the holding current is switched off, the contactor drops out. The energy stored in the contactor electromagnet is dissipated in a free-wheeling circuit or in an overvoltage protection device.

A disconnector lacks a mechanism for suppression of electric arcs, which occur when conductors carrying high currents are electrically interrupted. Thus, they are always off-load devices, intended to be opened only after current has been interrupted by some other control device.

SUMMARY

Disclosed embodiments provide an electrically controlled switch for high current switching operations and allowing different configurations of the projecting fixed contacts that may be selected according to the needs of the user or to the installation needs so that the accessibility of the fixed contacts may be modified depending on a specific configuration requested.

Disclosed embodiments provide a contactor which is simply to use and to be installed by any specialized operator.

Disclosed embodiments provide a contactor which guarantees a higher reliability and a long operating life.

Disclosed embodiments provide a contactor device that does not require complex manufacture.

Disclosed embodiments provide a structural solution that could be indifferently used in both switching devices such as a contactor device and/or as a disconnector device.

Disclosed embodiments provide a switch wherein the position of the terminal contacts used to connect the switch to the terminal contacts of the electrical power supply can be easily varied depending on specific configuration requirements.

DETAILED DESCRIPTION

Figure 1:
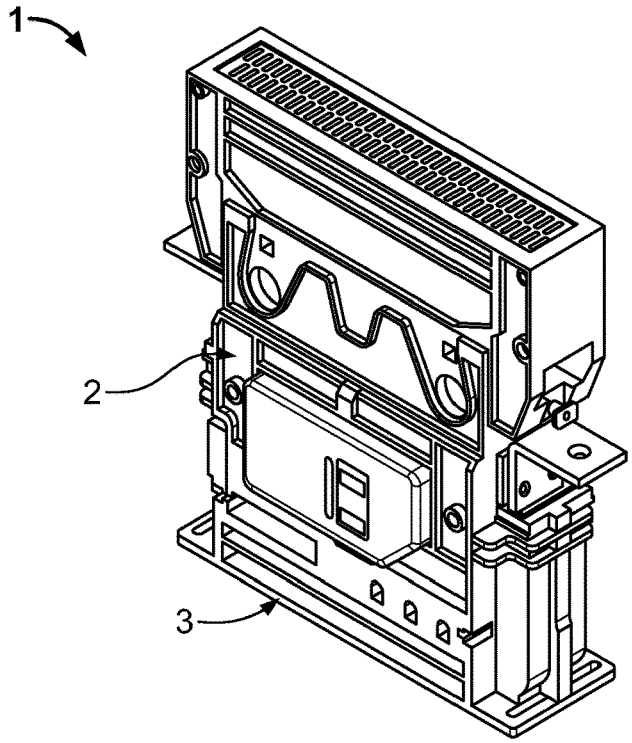
FIG. 1 shows a perspective view of a contactor realized according to the disclosed embodiments.

Herein below, reference will be made more specifically to a contactor with a specific configuration according to the disclosed embodiments, without this being intended to limit the rights of the Applicant with regard to the sector of disconnectors.

The contactors of know structure normally include fixed contacts and movable contacts.

Both contacts are linked to a branch of the power supply line to be connected and disconnected by bridge connectors or metal flexible connectors such as a copper braid. In particular, the movable contact is generally connected to the power supply terminal through a flexible connecting braid. The relatively high operating frequency of the switching device solicits the flexible connecting braid very much, so that it suffers for failures reducing the operating life of the switching device.

In order to guarantee an efficient switching action, movable contacts with a more complex structure has been provided.

For example, the Applicant in the Patent Application EP 3 293 748 A1 describes an improved contactor device for high current switching applications comprising a couple of moving contacts driven towards and away from each other and being mounted at the respective contact ends of a guide means activate by a low voltage driving portion incorporated in the switch base portion.

This moving mechanism of the moving contacts are less complex and less expensive and more reliable than other contactor devices of the same type.

Despite of the undoubted advantages provided by these contactors, there are still drawbacks especially for connecting the contactor with electrical power supply.

In fact, there could be different needs of connection of the contactor based on possible particular arrangements of the electrical power supply. More specifically, the terminal contacts of the electric power supply to which the contact must be connected could be located more or less close to each other or to the position of the contactor fixed contacts when the contactor is installed in a terminal box or in an installation environment.

The technical problem underlining the disclosed embodiments is that of providing an electrically controlled switch for high current switching operations and allowing different configurations of the projecting fixed contacts that may be selected according to the needs of the user or to the installation needs so that the accessibility of the fixed contacts may be modified depending on a specific configuration requested.

Another aim of the disclosed embodiments is to provide a contactor which is simply to use and to be installed by any specialized operator.

Disclosed embodiments provide a contactor which guarantees a higher reliability and a long operating life.

Disclosed embodiments provide a contactor device that does not require complex manufacture.

Disclosed embodiments provide a structural solution that could be indifferently used in both switching devices such as a contactor device and/or as a disconnector device.

Disclosed embodiments provide a switch wherein the position of the terminal contacts used to connect the switch to the terminal contacts of the electrical power supply can be easily varied depending on specific configuration requirements.

Optionally, the switch is electrically controlled.

Furthermore, the disclosed embodiments are explained with regard to a contactor, which is an example for a switch. However, the disclosed embodiments are also applicable to a disconnector, which is a further example for a switch.

According to the disclosed embodiments, the technical problem is solved by an (e.g. electrically controlled) switch for high current switching operations and with different configurations of fixed terminal contacts comprising a switch body, a couple of moving contacts, a guide means to drive the couple of moving contacts up to an abutting (contact) position, a housing groove running perimetric in the switch body and at least one contact bar for connecting each moving contact to a respective fixed terminal contact of the switch, the contact bar being hosted within at least a portion of the housing groove and having a free end projecting from the switch body to form the fixed terminal contacts through a corresponding aperture of the switch body located on a same lateral side or on opposite lateral sides, respectively.

Optionally, the switch body comprises different apertures corresponding to different configurations of the fixed terminal contacts.

Moreover, optionally, the electrically controlled switch comprises an electromagnet and auxiliaries contacts housed in the proximity of the switch body. These components are used to drive the guide means to bring in contact the moving contacts.

In the case of a contactor it is also provided an arc chute top portion forming an electric arc dissipation portion. This portion is not provided, as previously the, in a disconnector.

According to a particular aspect of the disclosed embodiments terminal contacts of the bars connected to a respective one of the couple of moving contacts project from the switch body towards opposite directions. This configuration is adopted when the connections of the electric power supply are located on opposite side of the contactor.

According to another aspect of the disclosed embodiments, terminal contacts of the bars connected to a respective one of the couple of moving contacts project from the switch body in the same direction. This configuration is adopted when the connections of the electric power supply are located on the same side of the contactor.

According to an optional aspect of the disclosed embodiments, the switch body is a parallelepiped flattened body.

According to this aspect the switch body is provided with a base and the terminal contacts of the bars connected to a respective one of the couple of moving contacts project from this base.

Moreover, according to an optional aspect, the switch body is connectable in a modular way to similar switch bodies. Particularly the parallelepiped flattened shape allows an easy and steady connection between the modules.

Optionally, the guide means comprises at least a couple of rods coupling by a hinge.

Optionally, the couple of rods have a corresponding end joined in a sliding hinge that may be moveable up and down along a vertical slot of a frame in the switch body. The rods are made by an insulating material and having respective opposite end hingedly coupled to a corresponding end of the arms opposite to the contacts. Each end of the arms opposite to the contacts are sustained by a corresponding elongated guides of an element made by the same insulating material of the rods and hingedly linked to a respective of the opposite ends.

Furthermore, according to a particular aspect, an end of the electromagnet is connected to an end of a lever around a fulcrum fixed or integral with the switch body, the lever providing an arm with a free end connected to the guide means. Moreover, an elastic element is interposed between the couple of moving contacts for compensating possible degradation or usury of the contacts.

Finally, it must be noted that the disclosed embodiments may be implemented in an electric system including at least an electrically controlled switch as disclosed in the following description.

Further features of the electrically controlled switch of the disclosed embodiments will appear from the following description given by way of not limiting example with reference to the enclosed drawings figures.

With reference to the drawings figures, with 1 is globally and schematically shown an electrically controlled switch, that in this particular case consists in a contactor, realized according to the disclosed embodiments.

In this embodiment, the contactor 1 is specifically provided for industrial applications wherein a high D.C. current must be switched on and off for high frequencies switching actions.

The contactor provides a switch body 2 including all the moving portions of the contactor 1 that will be disclosed hereinafter.

Optionally, the switch body 2 is shaped as a parallelepiped flattened body, but other different shapes are possible, all of these being comprised in the scope of protection of alleged claims.

The switch body 2 is generally made by a synthetic plastic material having a predetermined isolation coefficient. Such a switch body 2 in this exemplary embodiment has a base 3, which in the present embodiment is integrally formed with the switch body 2 and includes an internal frame 4 supporting the various moving components of the contactor 1.

The contactor 1 of the disclosed embodiments is structured to be used on electrical equipment working in presence of severe shocks and vibrations that normally occur onboard of traction vehicles.

However, nothing refrains from employing this kind of contactors 1 in all the applications wherein a high D.C. current must be switched on and off, for instance: line contactors, power switches or converters, traction motors, electromagnetic brakes and heating/air conditioning systems.

The contactor 1 comprises a switch base portion 5 and an upper arc chute top portion forming an electric arc dissipation portion. The switch base portion 5 includes electrical switching means. The arc dissipation portion is provided to cover and/or protect the electrical switching means. Therefore, the upper arc chute top portion 6 may be structurally different according to the different voltage ranges that must be treated and the corresponding arc chute type and energy capacity that shall be extinguished in total security.

For instance, an arc chute top portion 6 for a voltage value of 1000 V has to be smaller than an electric arc dissipation portion for a voltage value of 3000 V and has to be provided with smaller polar expansions.

Figure 2:
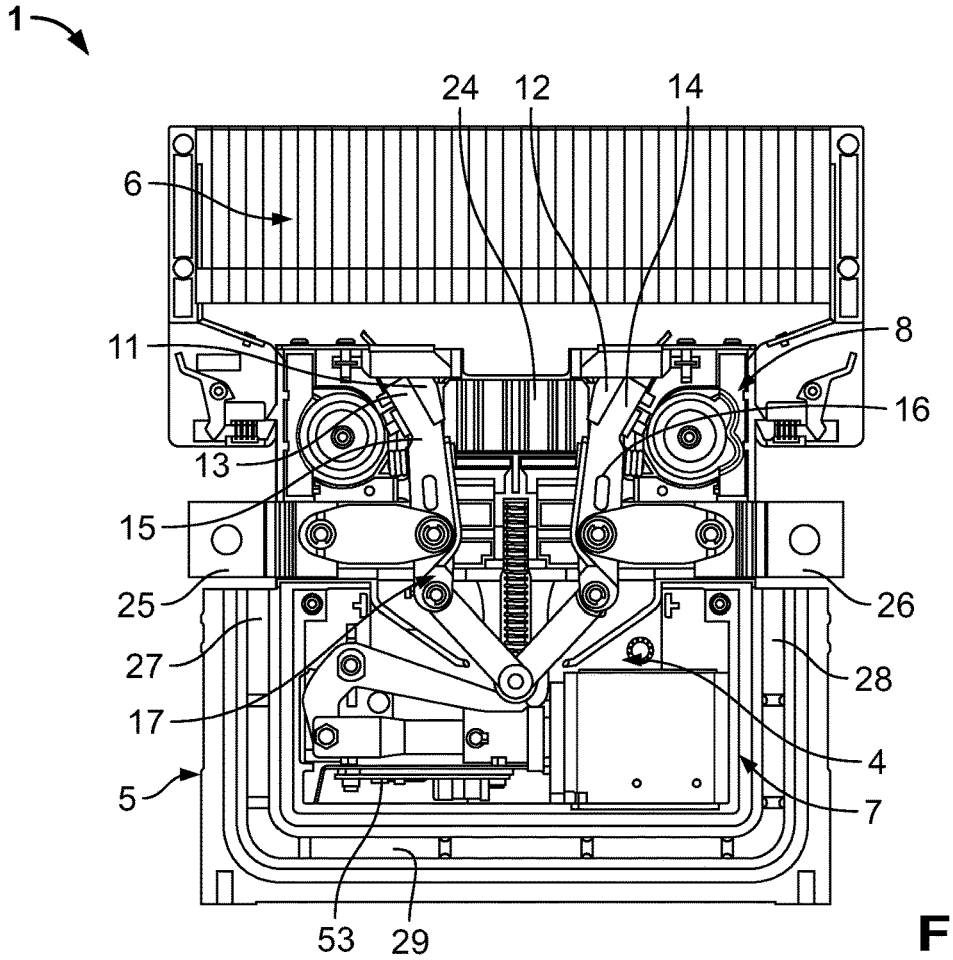
FIG. 2 shows a schematic view of the contactor of FIG. 1.
Figure 3:
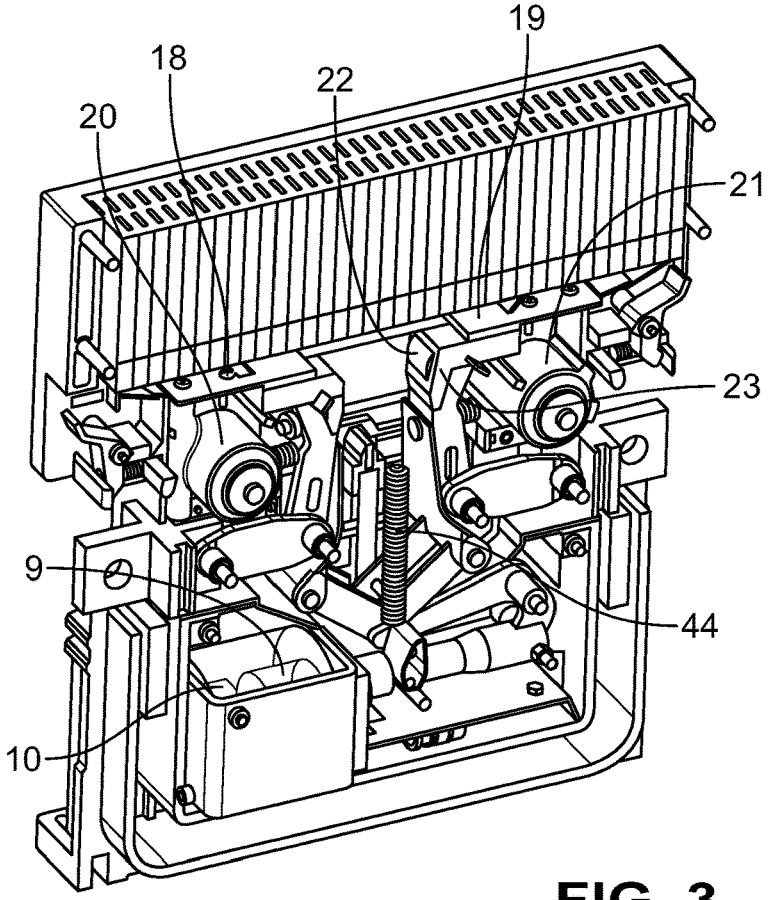
FIG. 3 shows a perspective and schematic view of the contactor of FIG. 1.

In FIGS. 2 and 3 the internal structure of the contactor 1 is clearly shown.

The switch base portion 5 may be considered separated in a low voltage portion 7 and a high voltage portion 8.

The low voltage portion 7 is provided for driving the switching of the high voltage portion 8. The low voltage portion 7 optionally comprises an electromagnet 9 and auxiliarie contacts (not shown). The electromagnet 9 is electrically supplied by a low voltage reference potential, not shown, being of a conventional type and driven by a suitable switching actuator.

This contactor 1 is a monostable element that is provided with normally open contacts according to the major part of user's needs.

According to the disclosed embodiments, the switch base portion 5 includes a couple of moving contacts 11 and 12 which shall be put in abutment one against the other for allowing the passage or flow of the high (AC or DC) current. Advantageously, the moving contacts 11, 12 are symmetrically moving towards and away from each other.

Each moving contact 11 or 12 is positioned at the contact end 13 or 14 of a corresponding elongated arm 15, 16 of a guide means 17. The arms 15, 16 are generally made of a conductive material, for instance a metal.

Over the contacts 11, 12, but still in the switch base portion 5, respective arc runners 18, 19 are provided.

Those arc runners 18, 19 help dissipating the electric arc formed during the opening phase of the moving contacts 11, 12. More particularly, each of the arc runners 18, 19 is electrically connected to a respective blow out coils 20, 21 provided at the shoulder of each contact end 13, 14 of each arm 15, 16. To each moving contact 11 or 12 it is associated a couple of lateral metal flanges 22, 23 having a projecting flag toward the corresponding arc runner 18 or 19. Moreover, a polar expansion 24, that is to say a metal plate or flange, duly shaped, is provided on both sides of the moving contacts 11, 12.

The contactor 1 provides terminal contacts 25 and 26, which are associated to the moving contacts 11 and 12 through contacts bars 27, 28. Optionally, the contact bars 27, 28 are made of copper.

The switch base portion 5, in particular the low voltage portion 7, according to the disclosed embodiments provides also a housing groove 29 which runs perimetric within the switch base portion 5 itself.

This housing groove 29 is optionally made of a plastic material and constitutes an insulated path for the contact bars 27, 28.

A plurality of apertures 30 are provided on an external surface 31 of the contactor 1, optionally on an external surface 31 of the low voltage portion 7. The plurality of apertures 30 can be provided wherever it is required for each particular configuration of the terminal contacts 25 and 26 on the sides of the low voltage portion 7.

The terminal contacts 25 and 26 project from the plurality of apertures 30. In particular, the terminal contacts 25 and 26 associated respectively to a contact bar 27 or 28 can project from different sides of the low voltage portion 7 depending on the specific application required.

Figure 4A:
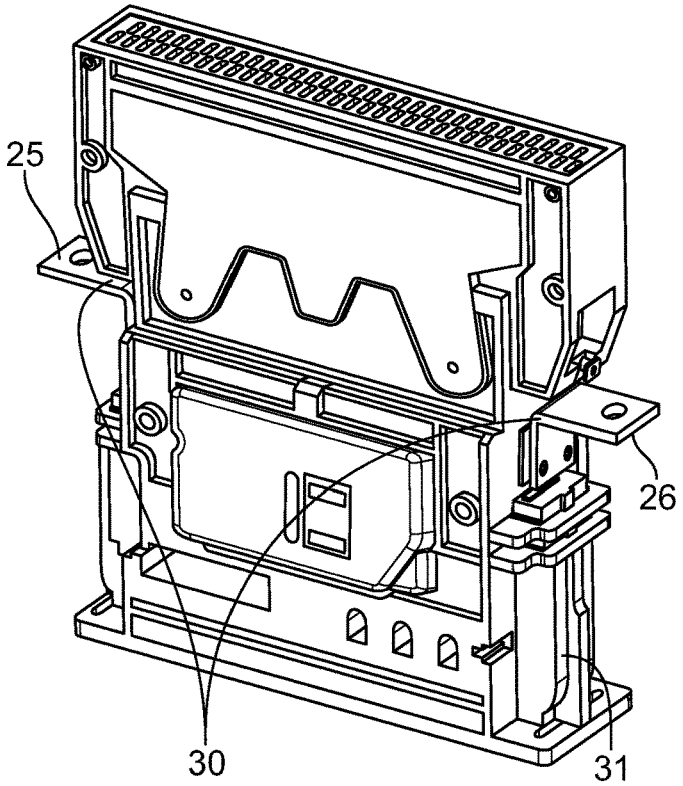
FIGS. 4A, 4B and 4C show different configurations of the contactor of FIG. 1 with different disposition of fixed terminal contacts.
Figure 4B:
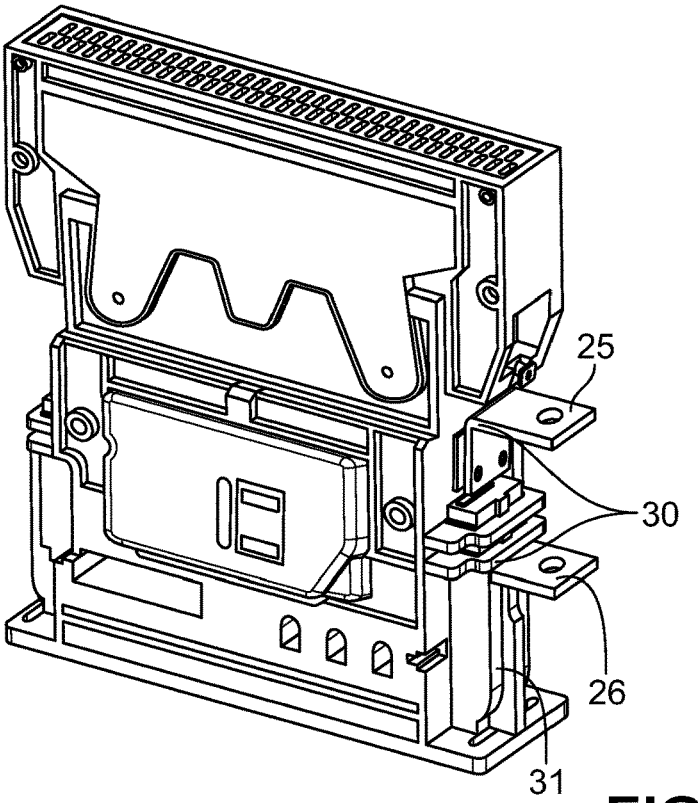
Figure 4C:
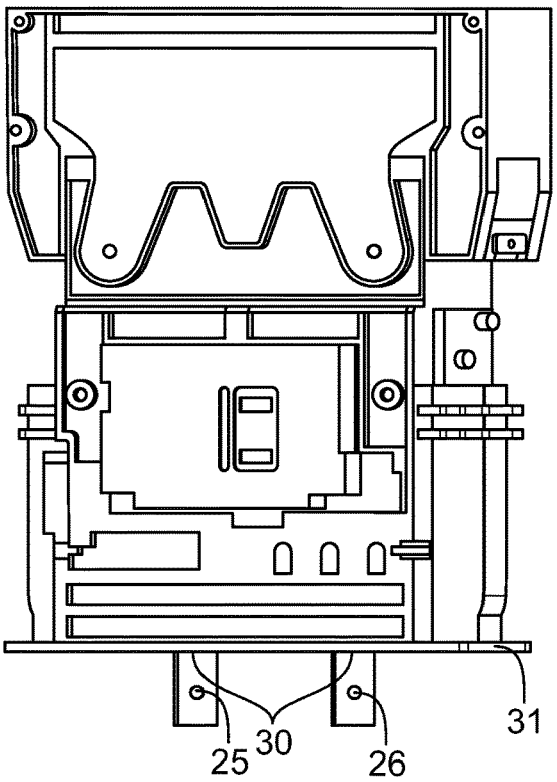

In FIGS. 4A, 4B and 4C are represented three possible arrangement configurations of the terminal contacts 25 and 26.

In particular, a configuration is shown in FIG. 4A wherein the terminal contacts 25 and 26 of the bars 27, 28 project from the apertures 30 of the switch body 2 towards opposite directions.

Differently, in FIG. 4B it is shown a configuration wherein the terminal contacts 25 and 26 of the bars 27, 28 project from the apertures 30 of the switch body 2 in the same direction.

In a specific case of the latter configuration, the terminal contacts 25 and 26 of the bars 27, 28 project from the apertures 30 of the switch body 2 from the base 3, as shown in FIG. 4C.

Other configurations are possible without to depart from the scope of protection defined from the alleged claims, even if quite unusual. For instance, it is possible to have a perpendicular configuration wherein one fixed terminal contact 25 or 26 projects from a side portion of the switch body 2 and the other fixed terminal contact 25 or 26 projects from the base 3 of the switch body 2.

Figure 5:
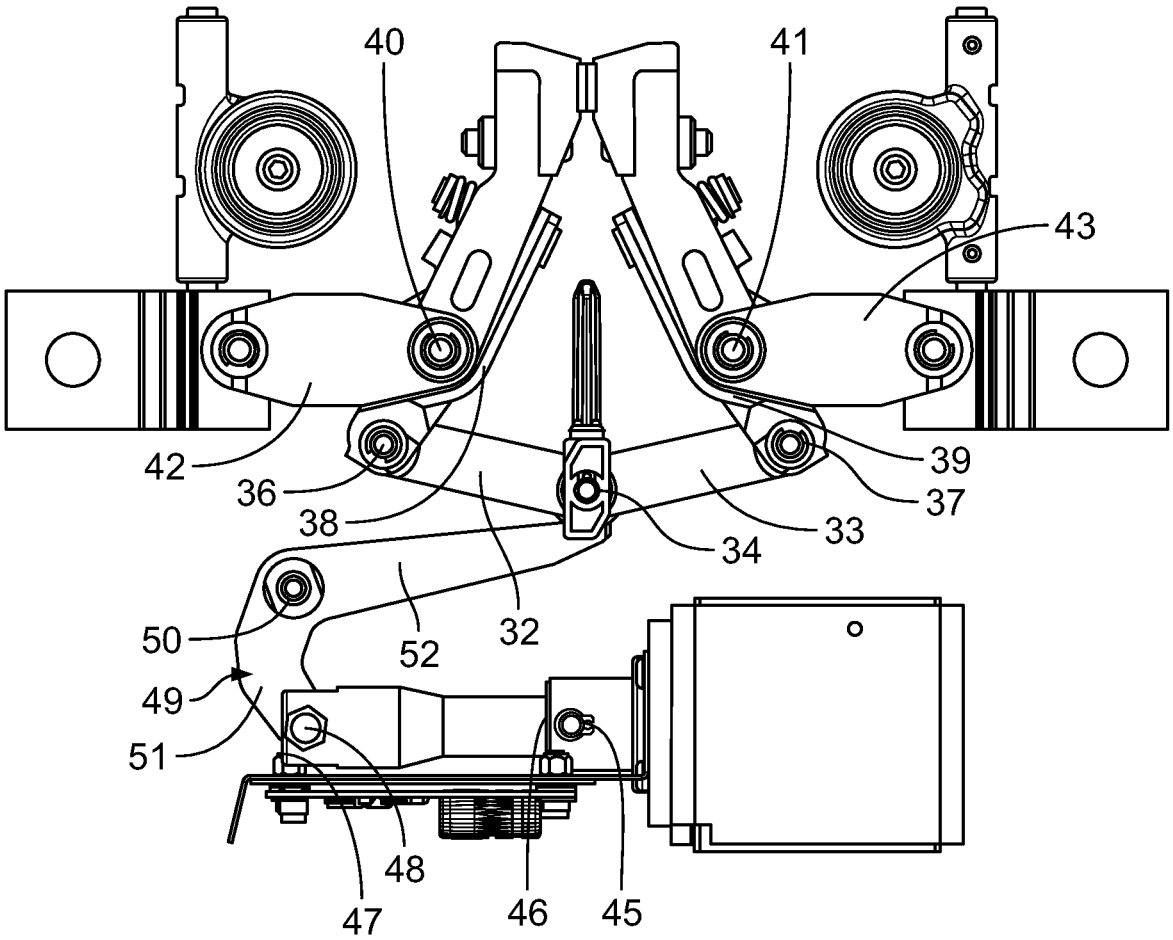
FIG. 5 shows a particular of activation mechanism of the contactor of FIG. 1.

FIG. 5 shows a schematic view of the guide means 17 that is used to activate the contactor 1.

Figure 2A:
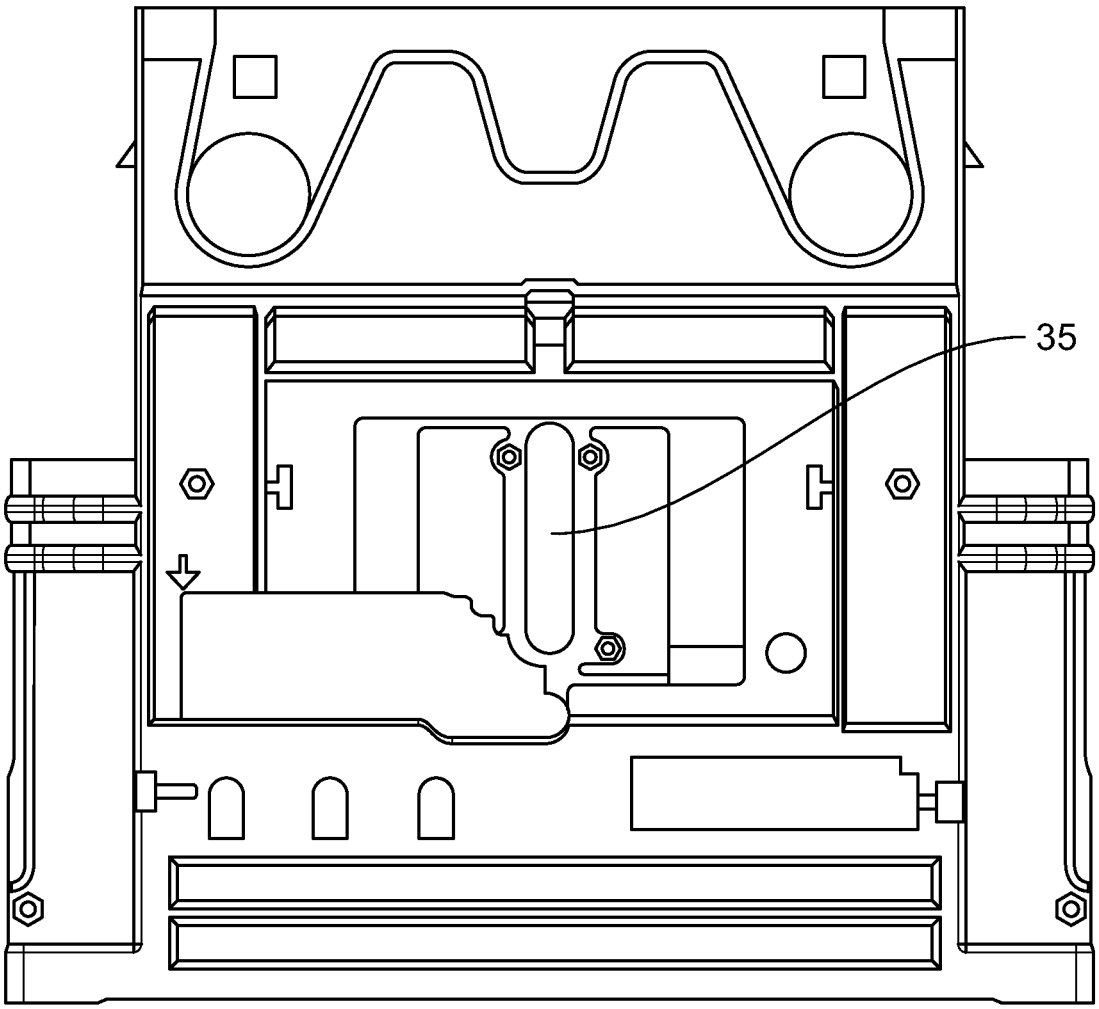
FIG. 2A shows a schematic view of the body of the contactor of FIG. 1.

The guide means 17 includes a couple of rods 32 and 33 that have a corresponding end joined in a sliding hinge 34 that may be moveable up and down along a vertical slot 35, visible in FIG. 2A, the rods thus moving up and down along such a vertical slot 35 on the switch body 2. The rods 31 and 32 are made by an insulating material, for instance a thermosetting material.

The opposite ends 36, 37 of each of the rods 32, 33 are hingedly linked to a corresponding elongated guide 38, 39 of an element made by the same insulating material of the rods 32, 33. Each arm 15 or 16 are hingedly downwardly linked to those elongated guide 38, 39 by corresponding pivot 40, 41 and upwardly to a case by means of corresponding springs (not shown).

So, the elongated guides 38, 39 are hingedly linked to the relative rod 32 or 33 but are also linked to the corresponding end of each arm 15, 16 so that the movement of the elongated guides 38, 39 reflects in a movement of the associated arm 15, 16.

The rods 32, 33 and the arms 15, 16, together with the corresponding sliding hinge 34, the pivots 40, 41 and the hingedly links between the rods 32, 33 with the elongated guides 38, 39, and indirectly with the arms 15, 16, form the guide means 17 that allows driving the moving electric contacts 11 and 12 one toward the other and vice versa. The guide means is activated by the low voltage driving portion 7.

Each of the arms 15, 16 is supported by the corresponding pivot 40, 41 but those pivots are extended transversally at the end of a fork like arm 42 or 43 respectively. Those fork arms 42, 43 are made by a conductive material such as a metal.

Those fork arms 42, 43 are substantially linked to the terminal contacts 25 and 26. Therefore, the electric continuity between the moving contacts 11, 12 and the terminal contacts 25, 26 is guaranteed by the metal continuity between the components 25, 42, 15 and 11 at one side and 26, 43, 16, and 12 on the other side.

It must be further noted that an elastic element 44, for instance a compression spring, is interposed between each arm 15 or 16 and the corresponding supporting fork like arm 42, 43 with the purpose to compensate possible degradation or usury of the arms 15, 16.

The sliding hinge 34 is provided with a central annular elastic element (not shown) and is forced to slide along the vertical slot 35.

The movement is actuated by the electromagnet 9, which is active on a movable core 45 connected to a stem 46 that is extended horizontally and parallel to the base 3 of the switch body 2.

The free or distal end 47 of the stem 46 is linked to one end 48 of a lever 49 which is pivotally mounted on a fulcrum 50 fixed or integral with the internal frame 4 of the base 3 of the contactor 1.

The lever 49 has a first arm 51 linked to the free distal end 47 of the stem 45 and another or second arm 52 free to move around the fulcrum when the lever 49 is actuated by the electromagnet 9 and the stem 45.

It should be finally noted that an electric circuit 53, shown in FIG. 2, is optionally provided for supplying the electromagnet 9 with a proper level of currents while different voltage values are provided by the user, according to the applicable standards. This circuit 49 is substantially a voltage level shifter suitable to receive a plurality of different voltage values, able to boost the electromagnet's current as required in the starting phase.

In view of the previous description it should be evident the functioning of the contactor 1.

Figure 6:
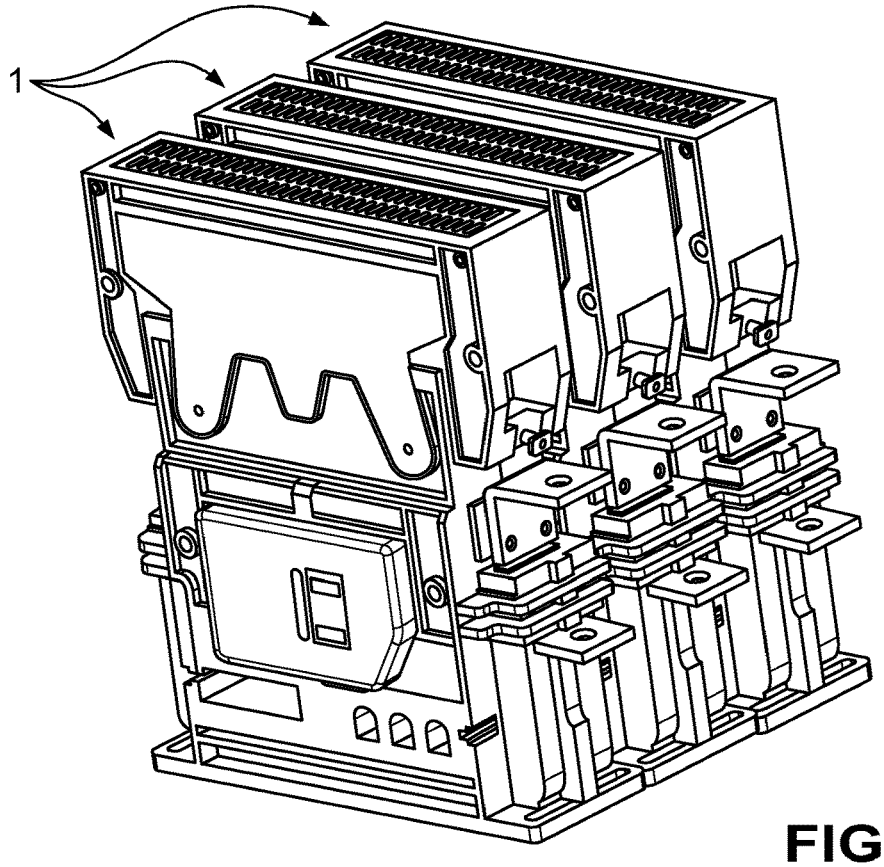
FIG. 6 shows a modular configuration of contactors realized according to the disclosed embodiments.

In several applications, the contactor 1 of the disclosed embodiments has a modular structure concerning a single pole configuration that may be doubled in a two poles configuration or provided in a three poles configuration including two or three parallel modules according to the user's needs, for instance as shown in FIG. 6.

The switch base portion 5 is common for each different modular contactor 1 while the arc dissipation portion may be considered as a top coverage of the switch body 2 that may have a different size according to the different power category and voltage ranges that the contactor 1 shall provide.

Figure 7:
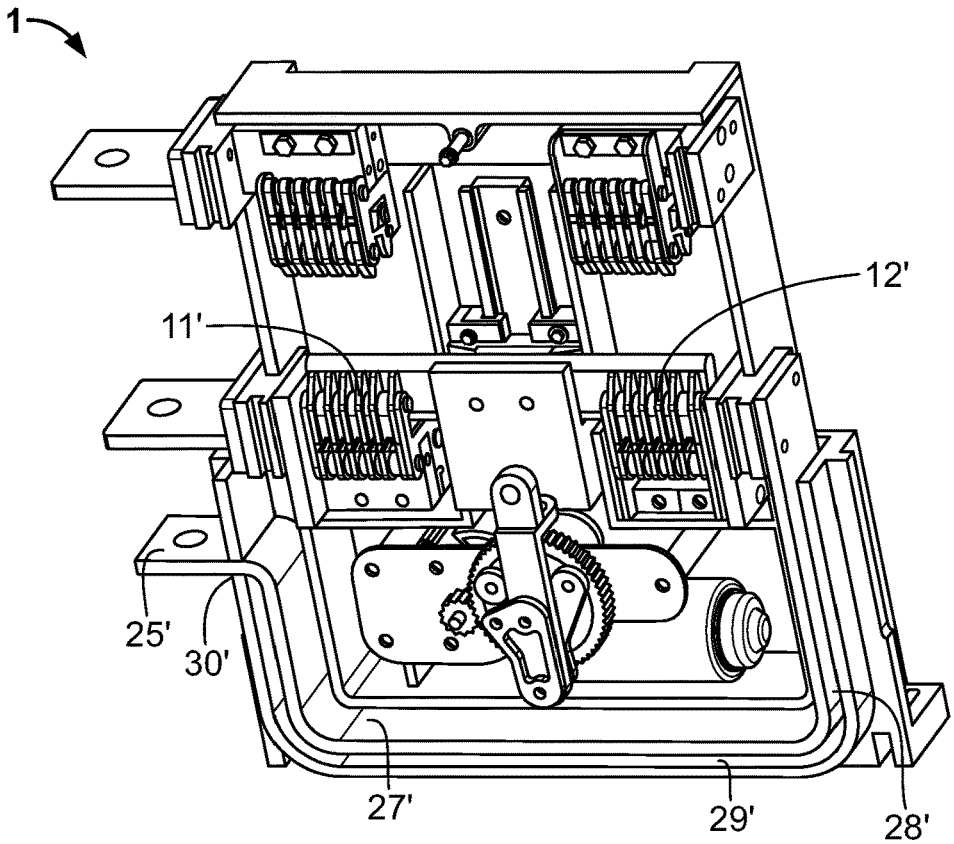
FIG. 7 shows a disconnector realized according to the disclosed embodiments.

As previously the, the disclosed embodiments which provide an electric controlled switch 1 is adapted not only for a contactor as shown in FIG. 1, but also for a disconnector, as shown in FIG. 7.

Terminal contacts 25' and 26' are associated to the moving contacts 11' and 12' through bars 27' and 28'.

The bars 27' and 28' are arranged in the housing groove 29'. The switch body 2' of the disconnector 1 is provided with a plurality of apertures 30', from which the terminal contacts 25', 26' project outside, being able to be connected to electric power supply in a plurality of different configurations, varying only the apertures 30' selected.

Even if the internal structure of the disconnector is different in some aspect from the internal structure of the contactor, the disclosed embodiments are related to the common part of their structure and it is not limited to one or the other application.

So, the disclosed embodiments are applicable in any electrical system which requires an electrical controlled switch, both a contactor or disconnector.

Advantageously, the disclosed embodiments are suitable in the most applications wherein a switch in high current is required, avoiding complications in the arrangements of the circuit.

Another advantage of the disclosed embodiments are that it is simply to use by any sector operator, not requiring any specific knowledge but being based only to visible requirements of connections.

Moreover, the insulated separation between the electrical portions and the housing groove within the electric switch avoids drawbacks during the arrangements of terminal contacts and guarantee in this way a higher reliability and a long operating life.

Another advantage of the disclosed embodiments are that it does not require particular manufacture, that is important for a component clearly intended for mass-production with high degree of flexibility toward the user requests.

Finally, the contactor according to the disclosed embodiments may be used also for switching in high AC current applications.

In the previous lines the directional terms like: "forward", "rearward", "front", "rear", "up", "down", "above", "below", "upward", "downward", "top", "bottom", "side", "vertical", "horizontal", "perpendicular" and "transverse" as well as any other similar directional terms refer just to the device as shown in the drawings and do not relate to a possible use of the same device. Accordingly, these directional terms, as utilized to describe the contactor in its upright vertical position on a horizontal surface have just the meaning to identify a portion of the device with respect to another portion as shown in the figures.

The term "comprising" and its derivatives, as used herein, are intended to be open ended terms that specify the presence of the stated features, elements, components, groups, integers, and/or steps, but do not exclude the presence of other unstated features, elements, components, groups, integers and/or steps. This concept also applies to words of similar meaning, for example, the terms "have", "include" and their derivatives.

Moreover, the terms "member", "section", "portion", "part" and "element" when used in the singular can have the dual meaning of a single part or a plurality of parts.

The invention claimed is:

1. A switch for high current switching operations, comprising:

a switch body;

a plurality of couple of moving contacts;

a guide that drives the plurality of moving contacts between a contact position and a disconnected position to switch or interrupt current;

a housing groove running perimetric in the switch body;

at least one contact bar for connecting one of the moving contacts to a respective fixed terminal contact of the switch, the contact bar being hosted within at least a portion of the housing groove and having a free end projecting from the switch body to form the fixed terminal contact through a corresponding aperture of the switch body, wherein the at least one contact bar is configured to be changeable, at least during final assembly of the switch, to adapt the configuration of the fixed terminal contacts, and wherein the at least one contact bar is replaceable during final assembly of the switch only, in order to adapt the configuration of the fixed terminal contacts, wherein the switch body comprises different apertures corresponding to different configurations of the fixed terminal contacts.

2. The switch of claim 1, further comprising:

an electromagnet housed in a switch base portion of the switch body;

auxiliaries contacts housed in the proximity of the switch base portion of the switch body.

3. The switch of claim 1, further comprising an arc chute top portion forming an electric arc dissipation portion, to establish a contactor.

4. The switch of claim 1, wherein the fixed terminal contacts project from the switch body towards opposite directions.

5. The switch of claim 1, wherein the fixed terminal contacts of the bars project from the switch body in the same direction.

6. The switch of claim 1, wherein the switch body is a parallelepiped flattened body.

7. The switch of claim 1, wherein the fixed terminal contacts project from a base of the switch body.

8. The switch of claim 1, wherein the switch body is connectable in a modular way to similar switch bodies.

9. The switch of claim 1, wherein the guide comprises at least a plurality of rods coupling by a hinge.

10. The switch of claim 1, wherein the electromagnet is active on a stem, the stem being connected to a lever around a fulcrum, the lever providing an arm connected to the guide.

11. The switch of claim 1, further comprising at least an elastic element interposed between the plurality of moving contacts.

12. An electrical system comprising at least one switch according to claim 1.

13. A kit for assembling a switch for high current switching operations, the kit comprising:

a switch body;

a plurality of moving contacts;

a guide that drives the plurality of moving contacts between a contact position and a disconnected position, to switch or interrupt the current; and a housing groove running perimetric in the switch body, wherein the switch is configured to host at least one contact bar for connecting one of the moving contacts to a respective fixed terminal contact of the switch, wherein the switch is configured to host at least one contact bar within at least a portion of the housing groove, at least one contact bar, having a free end projecting from the switch body to form the fixed terminal contact through a corresponding aperture of the switch body, and wherein the at least one contact bar is configured to be changeable during final assembly of the switch only, in order to adapt the configuration of the fixed terminal contacts, wherein the switch body comprises different apertures corresponding to different configurations of the fixed terminal contacts.

14. A contact bar from a kit for assembling a switch according to claim 13.

* * * * *